US006835105B1

(12) United States Patent
Nakamura et al.

(10) Patent No.: US 6,835,105 B1
(45) Date of Patent: Dec. 28, 2004

(54) CONNECTOR AND METHOD OF CONNECTING A CONNECTOR WITH A MATING CONNECTOR

(75) Inventors: Hideto Nakamura, Yokkaichi (JP); Naoya Kurimoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 10 days.

(21) Appl. No.: 10/696,435

(22) Filed: Oct. 29, 2003

(30) Foreign Application Priority Data

Oct. 30, 2002 (JP) ..... 2002-316520

(51) Int. Cl.[7] ..... H01R 13/514
(52) U.S. Cl. ..... 439/752; 439/595
(58) Field of Search ..... 439/752, 595

(56) References Cited

U.S. PATENT DOCUMENTS 5,183,418 A 2/1993 Yamanashi et al.
5,203,722 A 4/1993 Kinoshita
5,439,397 A 8/1995 Yamanashi et al.
5,468,162 A * 11/1995 Oda ..... 439/752
5,569,055 A 10/1996 Yamanashi et al.
5,573,432 A * 11/1996 Hatagishi ..... 439/752
5,997,365 A * 12/1999 Abe ..... 439/752
6,080,023 A 6/2000 Meulemeester et al.
6,592,411 B2 * 7/2003 Mase et al. ..... 439/752
6,645,015 B2 * 11/2003 Mase et al. ..... 439/752
6,659,798 B2 * 12/2003 Mase et al. ..... 439/595
6,695,651 B2 * 2/2004 Mase et al. ..... 439/752

FOREIGN PATENT DOCUMENTS

EP 1 150 388 A2 10/2001

* cited by examiner

*Primary Examiner*—Tho D. Ta
(74) *Attorney, Agent, or Firm*—Gerald E. Hespos; Anthony J. Casella

(57) ABSTRACT

Tapered retainer-side guides (49) are formed at opening edges of through holes (47) excluding their communicating areas with corresponding jig insertion openings (48), and the front end surface of a housing (10) is formed with slanted housing-side guides (15) in the communicating areas of the opening edges of the through holes (47) with the jig insertion openings (48) when a retainer (40) is at a full locking position. Slanted guiding surfaces are formed over the entire peripheries of the opening edges of the through holes (47) by the retainer-side guides (49) and the housing-side guides (15). Thus, tabs of male terminal fittings can be securely guided to insertion openings (14).

16 Claims, 12 Drawing Sheets

CONNECTOR AND METHOD OF CONNECTING A CONNECTOR WITH A MATING CONNECTOR

BACKGROUND OF THE INVENTION

1. Field of the Invention

The invention relates to a connector with a function of locking terminal fittings inserted into a housing.

2. Description of the Related Art

U.S. Pat. No. 5,439,397 discloses a connector with a housing that has opposite front and rear ends. The housing has cavities that extend from the front end to the rear end and locks that extend into the cavities. Female terminal fittings are inserted into the cavities from the rear and are locked by the locks. Insertion openings extend into the cavities from the front and allow the insertion of tabs of male terminal fittings. Mold-removal spaces also extend into the front of the housing so that the locks can be molded. The insertion holes and the mold-removal spaces communicate with each other.

The mold-removal spaces are narrower than the insertion openings for a normal size connector. Thus, slanted guide surfaces for guiding the tabs into the insertion openings can be formed at the upper or lower edges of the insertion openings, thereby taking advantage of a difference in these widths.

The locks for a miniaturized connector must be sufficiently wide to achieve the necessary strength even through the terminal fittings and cavities are narrow. Thus, the mold-removal spaces must be at least as wide as the insertion openings. In such a case, slanted guides cannot be formed at the edges of the insertion openings toward the mold-removal spaces, and the tabs may be inserted into the mold-removal spaces instead of into the cavities.

As a countermeasure, U.S. Pat. No. 5,203,702 discloses a retainer that is mountable into the housing in a direction normal to the inserting direction of the terminal fittings to lock the terminal fittings. The retainer has a front wall that extends along the front end of the housing. The front wall of the retainer has through holes that align with the insertion openings of the housing. Slanted guide surfaces are formed at the opening edges of the through holes. In this way, the slanted guide surfaces can be provided in areas corresponding to the mold-removal spaces.

A retainer mounted into a housing typically is displaceable between a partial locking position where the insertion of terminal fittings into cavities is permitted and a full locking position where the retainer engages and locks the terminal fittings. Accordingly, the front wall of the above-described retainer slides along the front-end surface of the housing as the retainer is displaced.

The terminal fittings can be inserted when the retainer is at the partial locking position. Additionally, the locks can be deformed away from the terminal fitting when the retainer is at the partial locking position so that the terminal fittings can be withdrawn from the cavity. Thus, it is necessary to form the front wall with jig insertion openings that face the mold-removal spaces when the retainer is at the partial locking position to enable the locks to be deformed by a jig inserted through the jig insertion opening.

The jig insertion openings can be formed separately from the through holes for a normal size connector. However, intervals between adjacent cavities are smaller for miniature connector. Thus, the jig insertion openings must communicate with the through holes for the other adjacent cavities. In such a case, a slanted guiding surface cannot be formed in an area of the opening edge of each through hole communicating with the jig insertion opening.

The present invention was developed in view of the above problem and an object thereof is to enable portions of mating terminal fittings to be securely guided into cavities.

SUMMARY OF THE INVENTION

The invention relates to a connector with a housing that has opposite front and rear ends. At least one cavity extends through the housing from the front end to the rear end. The housing is formed with at least one lock for locking a terminal fitting inserted into the cavity. The front-end surface of the housing has at least one insertion opening so that portions of at least one mating terminal fitting can be inserted into the cavity. At least one mold-removal space also is formed in the front end of the housing and is created as a mold for forming the lock is removed. The lock locks a terminal fitting inserted into the cavity. However, a jig can be inserted into the mold-removal space to disengage the lock from the terminal fitting so that the terminal fitting can be withdrawn. A retainer is displaceable at an angle to an inserting direction of the terminal fittings between a first position where the insertion and withdrawal of the terminal fitting is permitted and a second position where the retainer engages and locks the terminal fitting in the housing. The retainer has a front wall that is slidable substantially along the front-end surface of the housing. The front wall of the retainer has at least one through hole that faces the insertion opening when the retainer is at the second position. The front wall of the retainer also has at least one jig insertion opening that faces the mold-removal space when the retainer is at the first position. A tapered retainer-side guide is formed in an area of the opening edge of each through hole, and the front-end surface of the housing has at least one tapered housing-side guide.

The corresponding through holes and jig insertion openings preferably communicate with each other.

A tapered retainer-side guide preferably is formed in an area of the opening edge of each through hole excluding a communicating area with the corresponding jig insertion opening.

The tapered housing-side guides preferably are at the areas of the opening edges of the through holes that communicate with the jig insertion openings when the retainer is at the second position.

The slanted guiding surfaces are formed over substantially the entire periphery of the opening edge of the through hole by the retainer-side guide and the housing-side guide even if each through hole communicates with the corresponding jig insertion opening for the other adjacent cavity. Thus, the tab of a male terminal fitting can be guided securely to the insertion opening.

Guiding means preferably are provided at each housing-side guide and the opening edge of the corresponding jig insertion opening for sliding contact with each other and at least one of the guiding means is substantially parallel with a sliding direction of the front wall as the retainer is displaced.

The guiding means preferably slide in contact with each other when the front wall is slid. Thus, the front wall can be moved along a specified path.

A surface of each housing-side guide opposite the corresponding insertion opening may define a slanted introducing surface substantially facing the opening edge of the jig insertion opening for the adjacent cavity. Thus, the jig can be inserted easily into the jig insertion openings.

The front wall preferably has at least one reinforcement projecting at an angle to a wall surface of the front wall and extending substantially in transverse direction. The reinforcement prevents the front wall of the retainer from being curved along forward and backward directions.

The retainer preferably comprises two supports extending from the opposite lateral walls of the retainer main body. The front wall preferably spans at least partly between the front edges of the supports and preferably is located substantially along the front-end surface of the housing.

At least one of the left and right edges of the reinforcement preferably is coupled to the support These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 2:
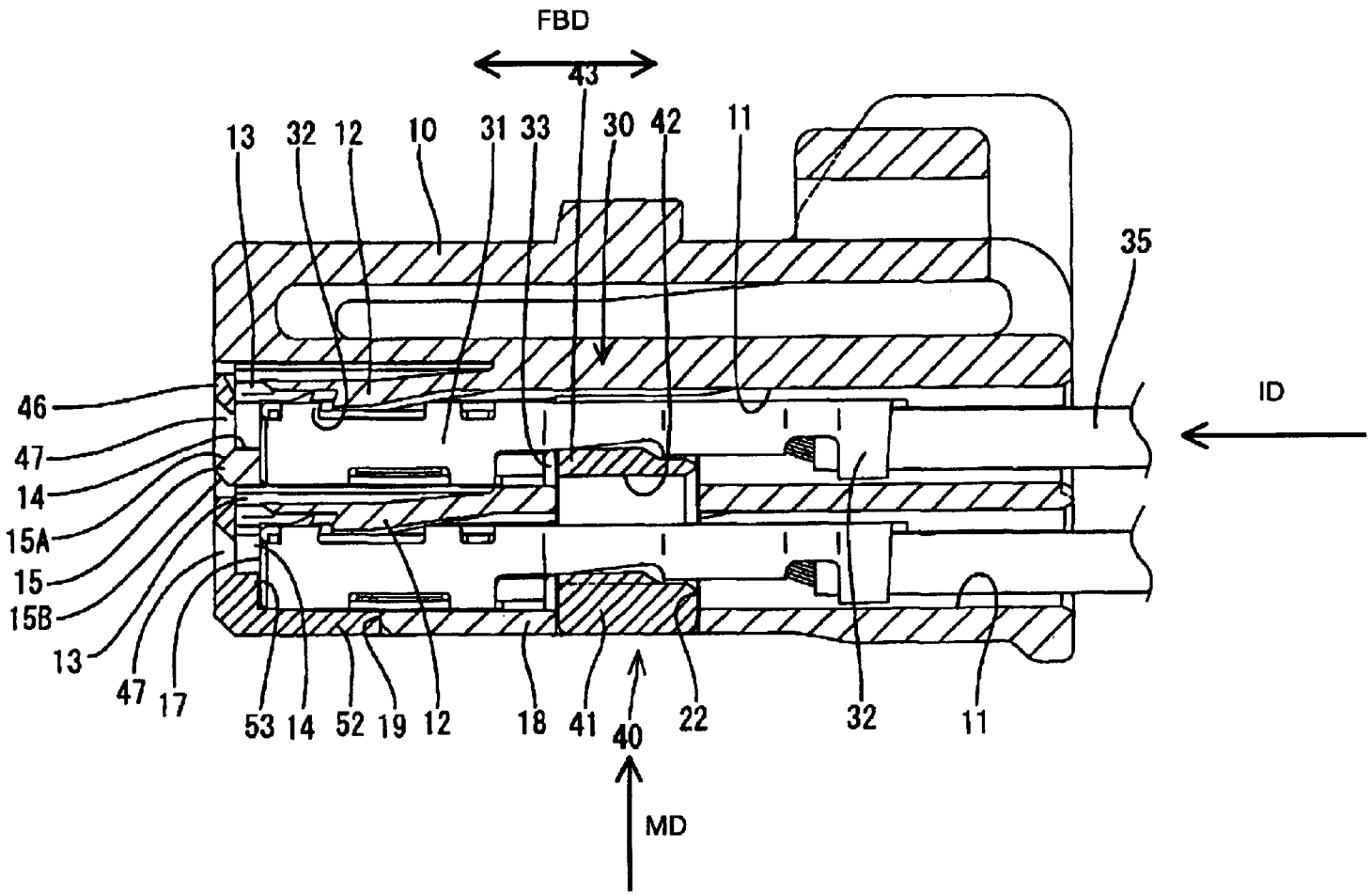
FIG. 2 is a section showing the state where the retainer is fully locked.

A connector according to the invention includes a housing 10 with opposite front and rear ends. The front end is to the left in FIG. 2 and is configured for mating with an unillustrated mating connector. Cavities 11 are arranged at specified intervals in upper and lower stages in the housing 10 so that the same numbers of cavities 11 are arrayed at each stage. The cavities 11 are narrow and long along forward and backward directions and are open in the front and rear ends of the housing 10. The respective cavities 11 at the upper stage align vertically with those at the lower stage.

A lock 12 is cantilevered forwardly from a ceiling wall of each cavity 11 serves as a preferably cantilever-shaped locking portion 12. The upper surface of the lock 12 of each cavity 11 at the lower stage faces the corresponding cavity 11 at the upper stage. Mold-removal spaces 13 are formed by removing a mold for forming the locks 12 and extend from the respective locks 12 to the front end of the housing 10. The front-end surface of the housing 10 is formed with substantially rectangular insertion openings 14 for allowing insertion of tabs of male terminal fittings (not shown) into the cavities 11 from the front. The insertion openings 14 are narrower than the mold-removal spaces 13 and the cavities 11, and are located above the bottom walls of the cavities 11. The respective insertion openings 14 communicate with the mold-removal spaces 13 located above the insertion openings 14.

A housing-side guide 15 projects at the front end surface of the housing 10 and extends substantially along the bottom side of the opening edge of the insertion opening 14 of each cavity 11 at the upper stage. The guide 15 has a guide surface 15A sloped down to the front from the bottom edge of the insertion opening 14. The guide 15 also has an introducing surface 15B sloped down to the back toward the upper side of the opening edge of the corresponding mold-removal space 13 at the lower stage. The left and right surfaces of each guide 15 are at substantially the same positions as the left and right sides of the opening edge of the corresponding insertion opening 14 with respect to the transverse direction TD when viewed from the front, and the left and right surfaces of the guide 15 define substantially flat guiding surfaces 16.

A narrow accommodating portion 17 is formed over substantially the entire width at the bottom end of the front-end surface of the housing 10. The accommodating portion 17 communicates with the bottom edges of the insertion openings 14 of the cavities 11 at the lower stage, and the back end surface of the accommodating portion 17 is substantially at the same position as front walls of the cavities 11 along forward and backward directions FBD. Thus, the accommodating portion 17 exposes lower halves of the cavities 11 at the lower stage at the front-end surface of the housing 10.

A bottom wall 18 of the housing 10 defines bottom walls of the cavities 11 at the lower stage, and has a cut-away portion 19 at the front end of the housing 10. The cut-away portion 19 is open up to the front end surface of the housing 10 and communicates with the accommodating portion 17. It should be noted that the bottom wall and the locks 12 are on surfaces substantially vertically opposed to each other in the cavities 11 at the lower stage.

Mounting recesses 20 are formed in the left and right outer surfaces of the housing 10 and open at the front-end surface and the bottom surface of the housing 10. Upper and lower locking projections 21 are formed in each mounting recess 20.

A mount space 22 opens in the bottom surface of the housing 10 and the mounting recesses 20. The mount space 22 penetrates the cavities 11 at the lower stage vertically and substantially normal to both the forward and backward directions FBD and the insertion direction ID of the terminal fittings 30 into the respective cavities 11of the lower stage. The mount space22 also communicates with the cavities 11 at the upper stage.

The connector also includes female terminal fittings 30 that can be inserted into the cavities 11. Each female terminal fitting 30 has a substantially rectangular tube 31 at its front end and a wire-crimping portion 32 at its rear end. A first engaging portion 33 is formed on the upper surface of the rectangular tube 31 for engaging the lock 12, and a second engaging portion 34 is formed at the rear bottom end of the rectangular tube 31. The wire-crimping portion 32 is configured to be crimped, bent or folded into connection with a wire 35.

The connector also has a retainer 40 with a main body 41 that is narrow and wide along a transverse direction TD and that can be accommodated in the mount space 22 along a mounting direction MD. The main body 41 has substantially rectangular terminal insertion holes 42 corresponding to the respective cavities 11 at the lower stage. Locking sections 43 are formed on the bottom surfaces of the respective terminal insertion holes 42 for engaging the female terminal fittings 30 inserted along the inserting direction ID into the cavities 11 at the lower stage, and also are formed on the upper surface of the main body 41 for engaging the female terminal fittings 30 inserted into the cavities 11 at the upper stage.

Figure 4:
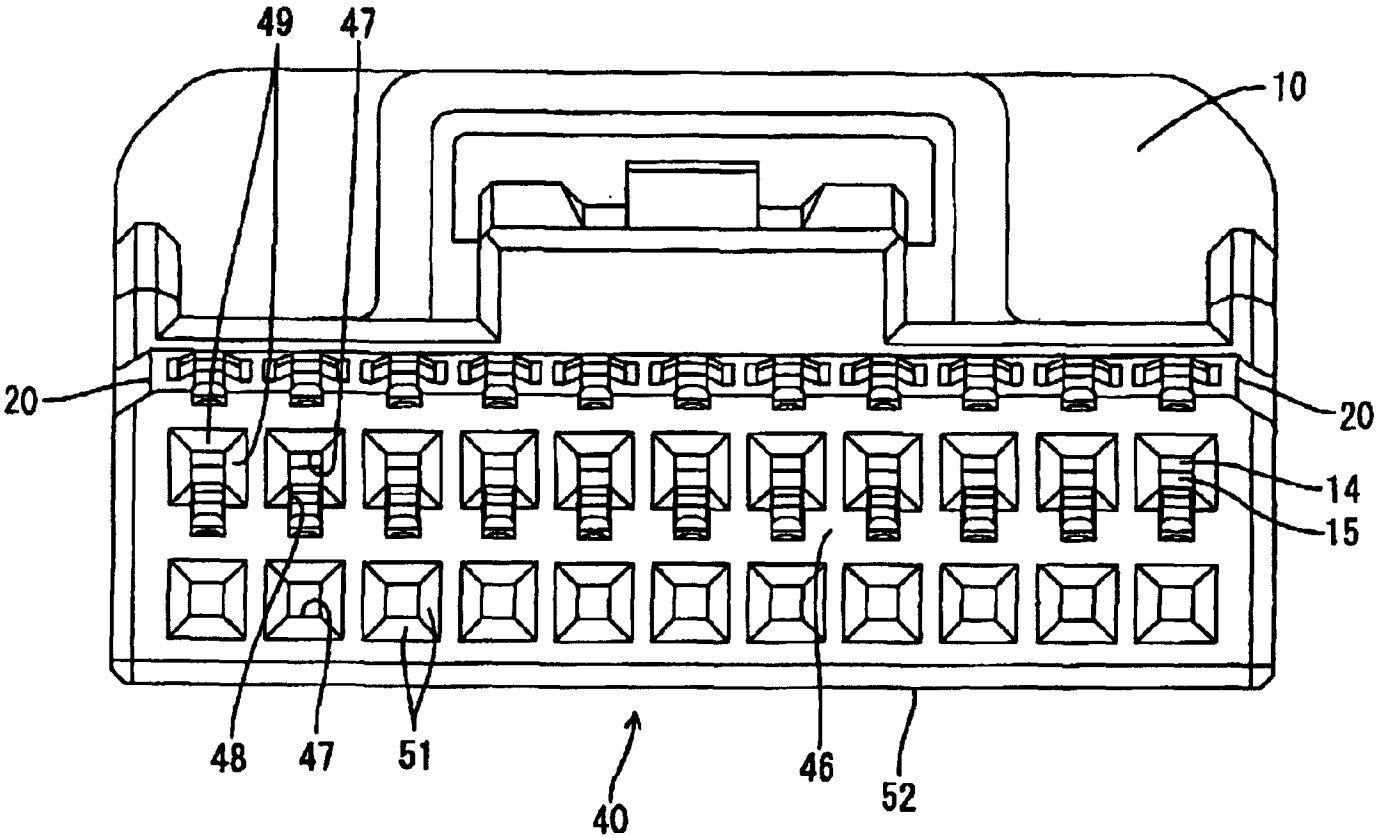
FIG. 4 is a front view showing a state where the retainer is partly locked.
Figure 5:
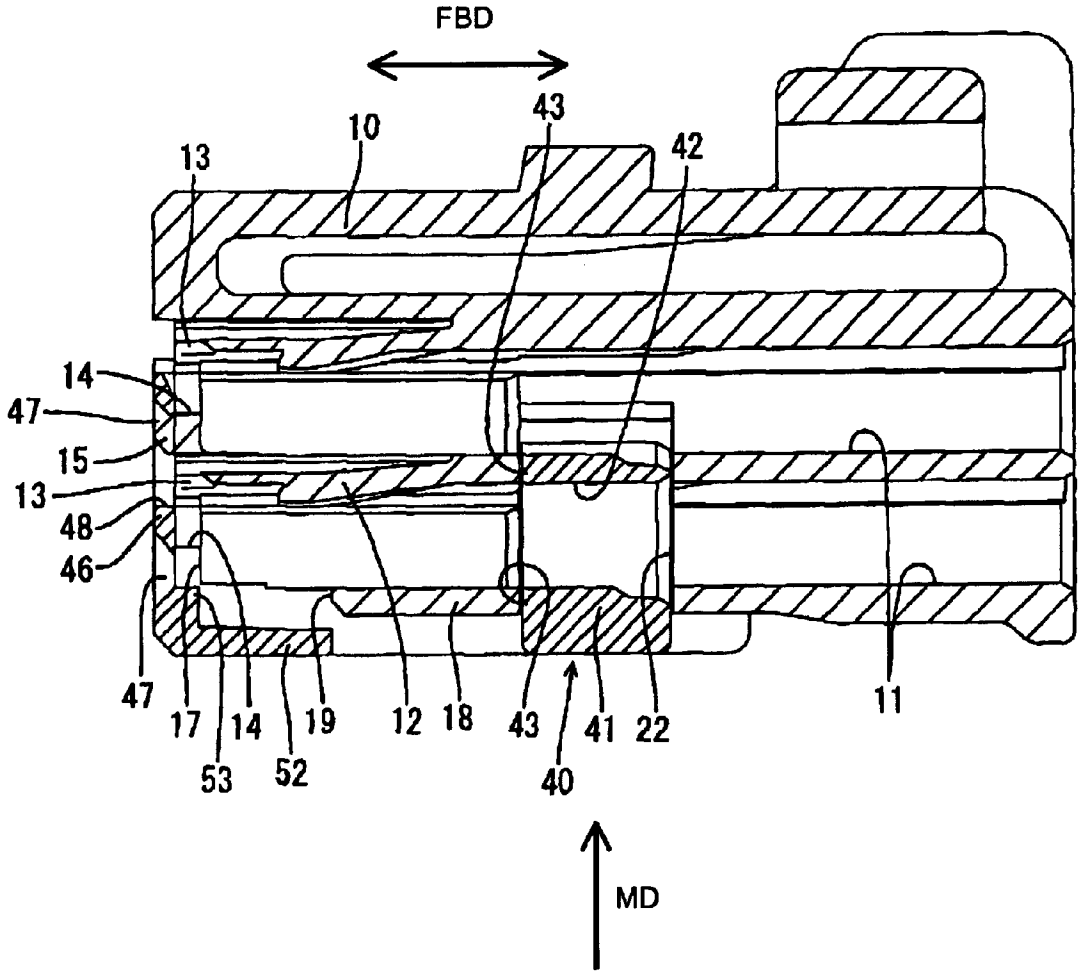
FIG. 5 is a section showing the state where the retainer is partly locked.
Figure 6A:
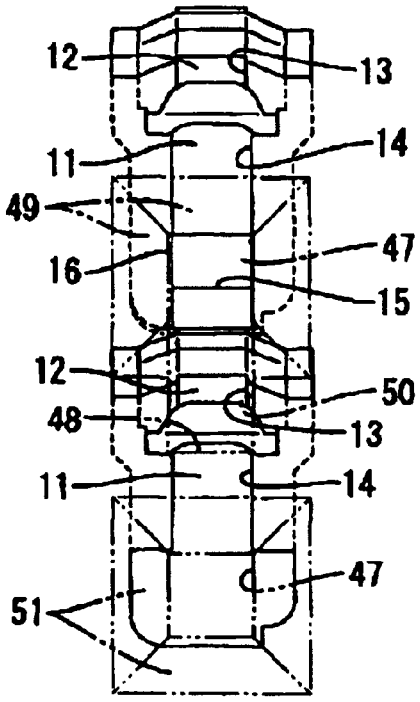
FIGS. 6(*a*) and 6(*b*) are a partial enlarged front view and a partial enlarged section showing the state where the retainer is partly locked.
Figure 6B:
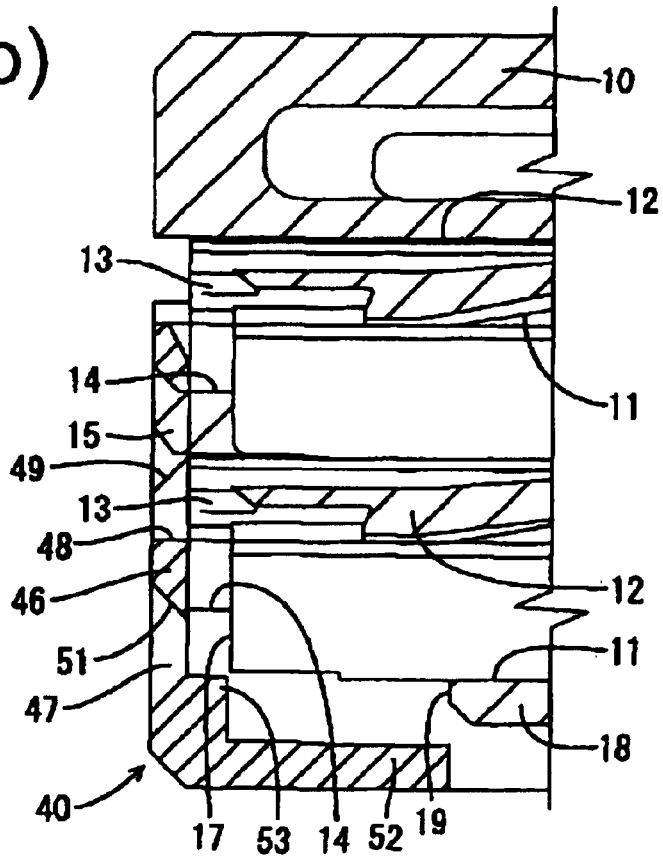

The retainer 40 has left and right supports 44 that extend vertically and in forward and backward directions FBD from left and right ends of the main body 41. A locking projection 45 is formed on the inner side surface of each support 44 and is engageable with the corresponding locking projections 21 of the housing 10. The supports 44 fit in the mounting recesses 20 when the retainer 40 is mounted on the housing 10 so that most of the main body 41 is accommodated in the mount space 22. Additionally, each locking projection 45 is engaged between the corresponding pair of locking projections 21. Thus, the retainer 40 can be held at a partial locking position where the terminal fittings 30 can be inserted into and withdrawn from the cavities 11 (see FIGS. 4 to 6).

Figure 1:
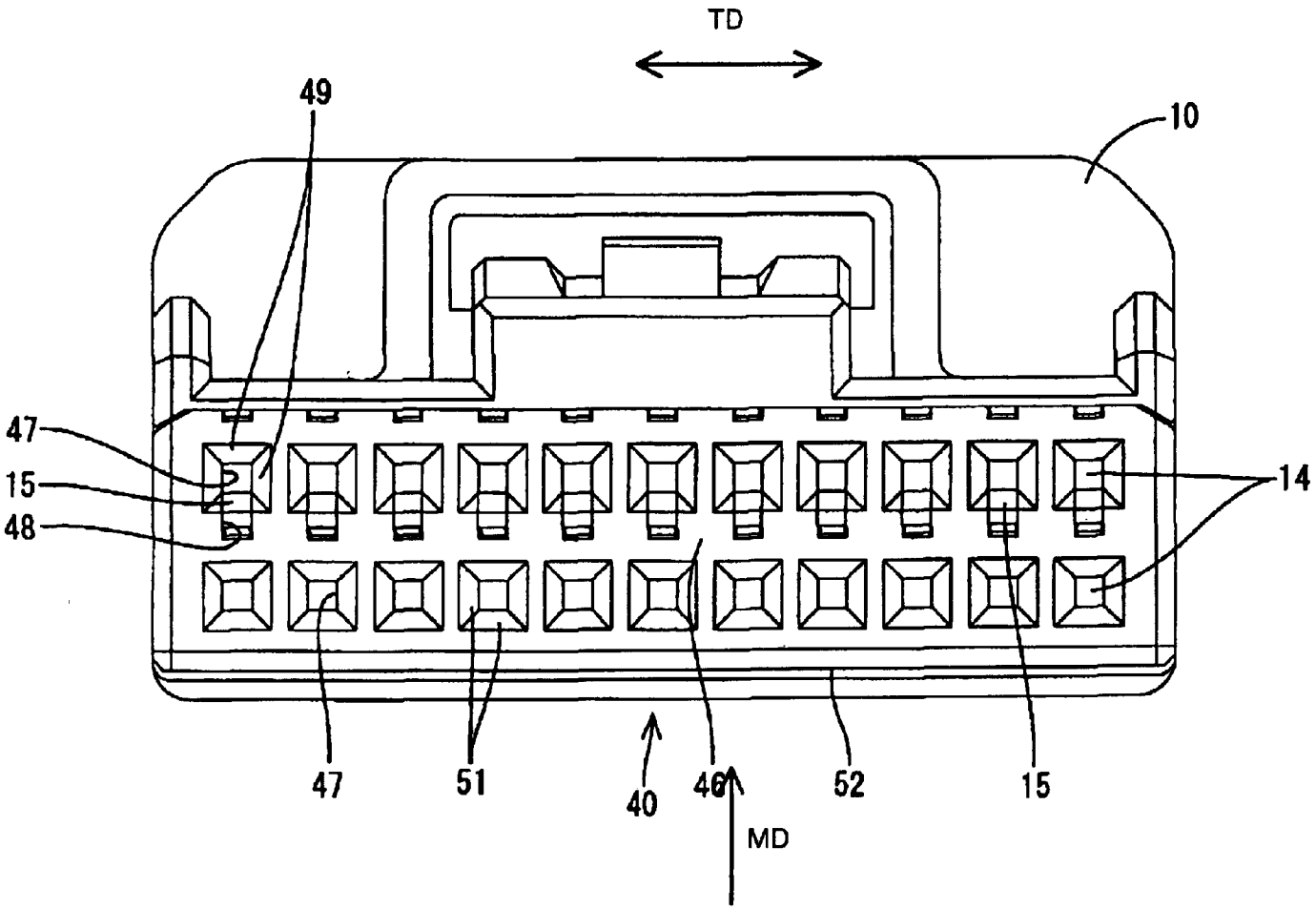
FIG. 1 is a front view showing a state where a retainer is fully locked in one embodiment of the invention.
Figure 3A:
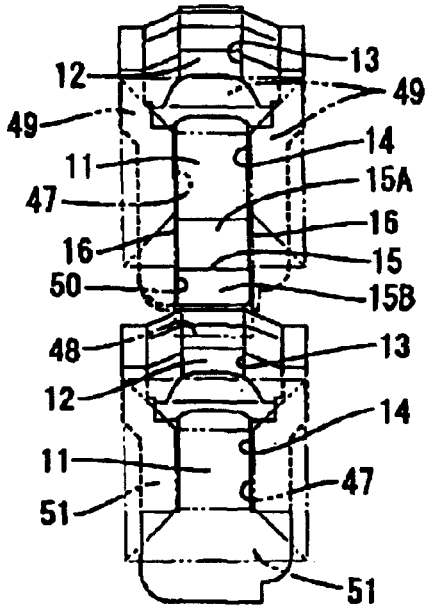
FIGS. 3(*a*) and 3(*b*) are a partial enlarged front view and a partial enlarged section showing the state where the retainer is fully locked.
Figure 3B:
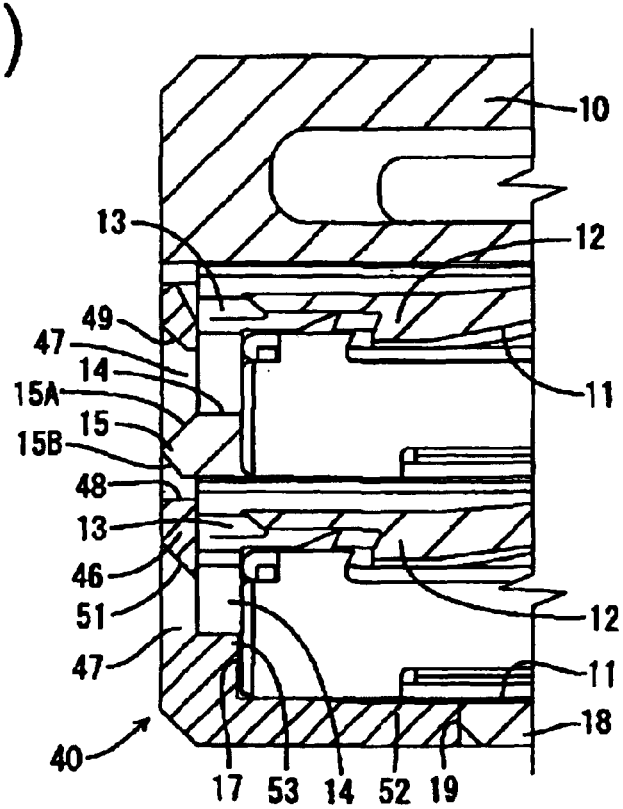

The retainer 40 can be moved in a mounting direction MD substantially perpendicular to the forward and backward directions FBD to a full locking position after the female terminal fittings 30 are inserted properly into the respective cavities 11. Thus, the retainer main body 41 is accommodated substantially completely in the mount space 22 and the respective locks 43 contact the second engaging portions 34 of the female terminal fittings 30 from behind. As a result the female terminal fittings 30 are locked. At this time, the supports 44 contact the upper edges of the mounting recesses 20 from below and the locking projections 45 engage the upper locking projections 21 to hold the retainer 40 at the full locking position (see FIGS. 1 to 3).

A substantially rectangular front wall 46 spans the front edges of the left and right supports 44. The front wall 46 is a substantially flat plate that slides in close contact with the front end surface of the housing 10 when the retainer 40 is moved vertically along the mounting direction MD between the partial locking position and the full locking position. The front wall 46 has substantially rectangular through holes 47 that align with the respective insertion openings 14 when the retainer 40 is at the full locking position. Substantially rectangular jig insertion openings 48 penetrate the front wall 46 and face the mold-removal spaces 13 of the cavities 11 at the lower stage when the retainer 40 is at the partial locking position. The partial locking position is lower than the full locking position along the mounting direction MD. The width of the jig insertion openings 48 is substantially equal the width of the through holes 47, and the jig insertion openings48 communicate with the through holes 47 corresponding to the cavities 11 at the upper stage. Tapered retainer-side guides 49 are formed along three sides of the opening edge of each through hole 47 corresponding to the cavity 11 at the upper stage excluding the lower side. The tapered retainer-side guides 49 communicate with the jig insertion opening 48. Left and right inner surfaces of each jig insertion opening 48 define substantially flat guiding surfaces 50 that slide in contact with the guiding surfaces 16 of the corresponding housing-side guide 15 of the housing 10. Retainer-side guides 51 are formed along all four sides of the opening edge of each through hole 47 corresponding to the cavity 11 at the lower stage.

A reinforcing wall 52 is formed at the bottom end of the front wall 46 and extends substantially horizontally back over substantially the entire width. The reinforcing wall 52 projects substantially at a right angle to the front wall 46, and the opposite left and right ends thereof are coupled to the bottom ends of the supports 44. The reinforcing wall 52 is accommodated in the cut-away portion 19 of the housing 10 when the retainer 40 is held at the full locking position. In this state, the lower surface of the reinforcing wall 52 is substantially flush with the lower surface of the bottom wall 18 of the housing 10, and the upper surface of the front end of the reinforcing wall 52 faces the front ends of the cavities 11 at the lower stage from below. In other words, the upper surface of the front end of the reinforcing wall 52 forms a part of the bottom walls of the cavities 11.

A bulge 53 is formed over substantially the entire width at an inner corner where the front wall 46 and the reinforcing wall 52 meet to increase the thicknesses of the front wall 46 and the reinforcing wall 52. The bulge 53 projects back from the front wall 46 and projects up from the reinforcing wall 52. The bulge 53 is accommodated in the accommodating portion 17 of the housing 10 and the rear surface of the bulge 53 faces the cavities 11 at the lower stage from the front when the retainer 40 is at the full locking position. Accordingly, the bulge 53 forms a part of the front walls of the cavities 11.

Figure 7:
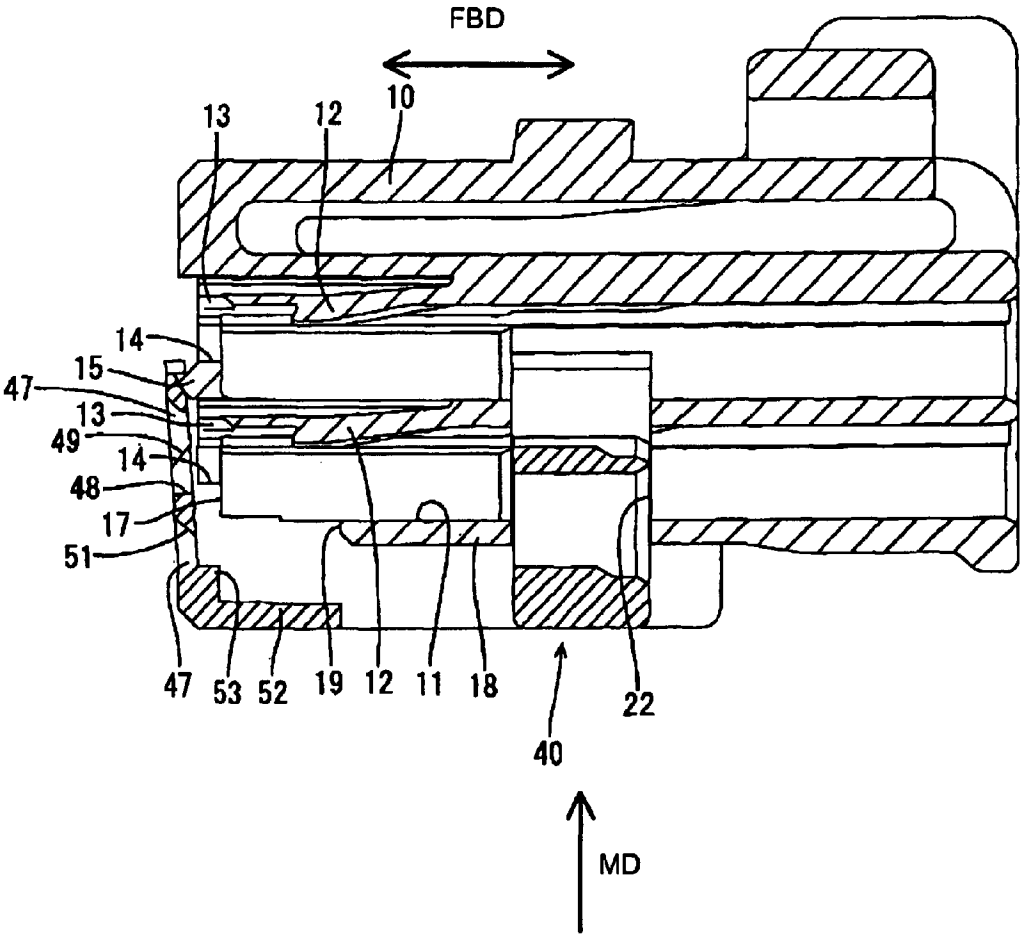
FIG. 7 is a section showing an intermediate state of mounting the retainer into a housing.
Figure 8:
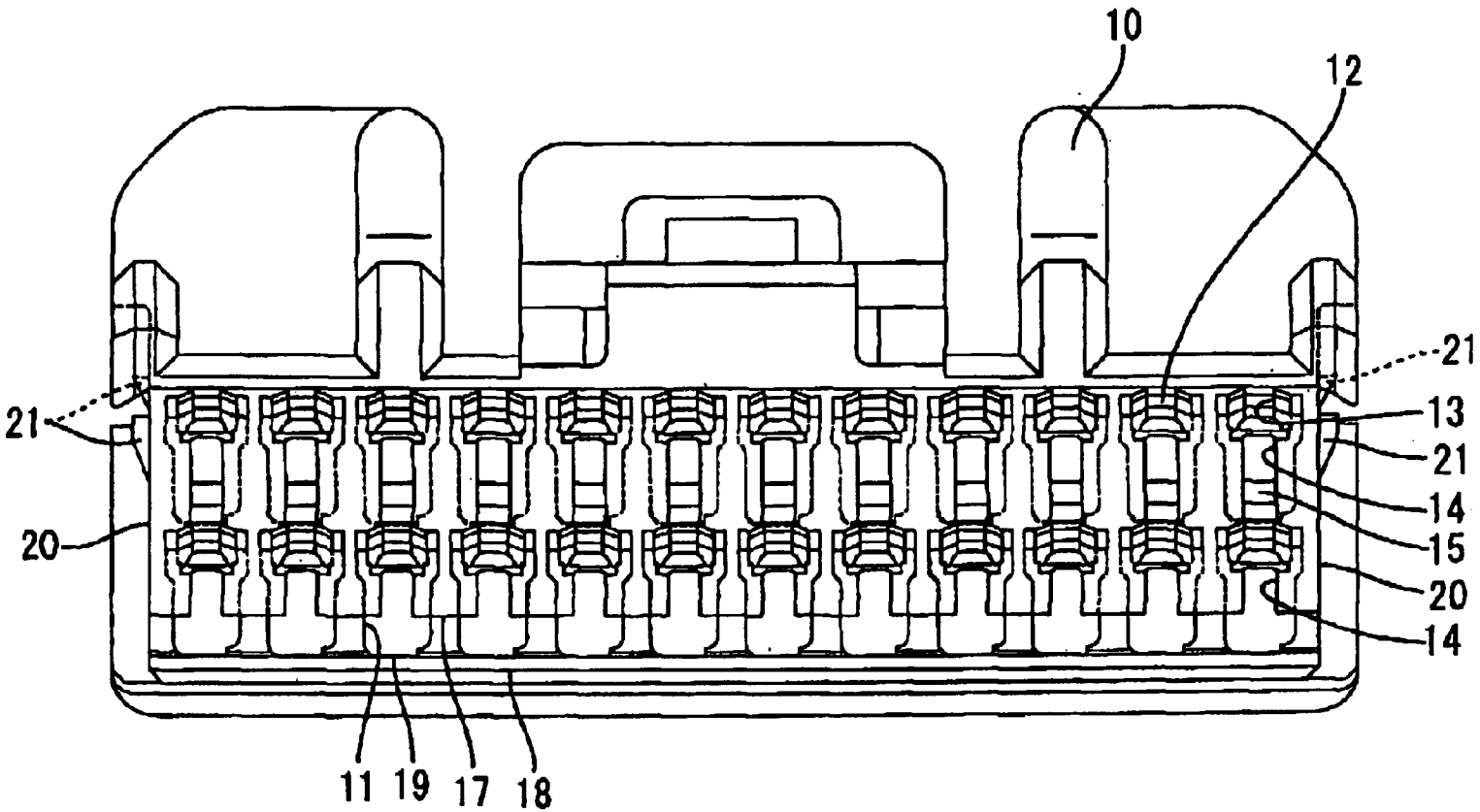
FIG. 8 is a front view of the housing.
Figure 9:
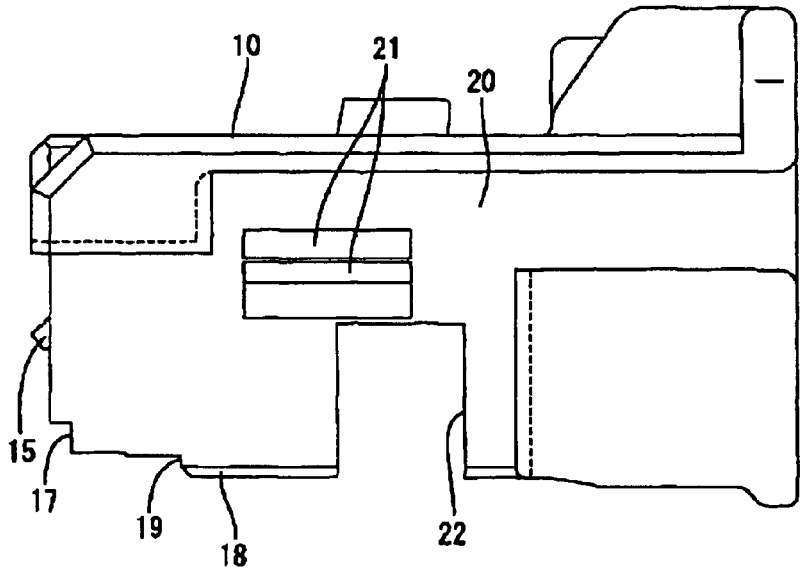
FIG. 9 is a side view of the housing.
Figure 10:
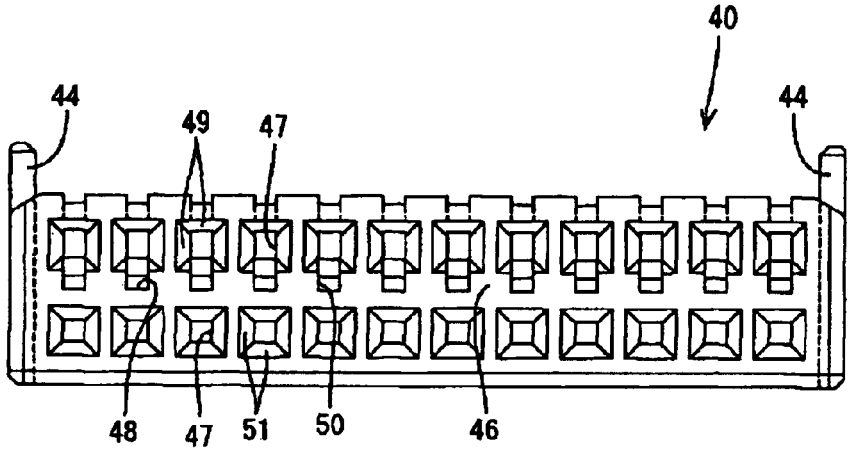
FIG. 10 is a front view of the retainer.
Figure 11:
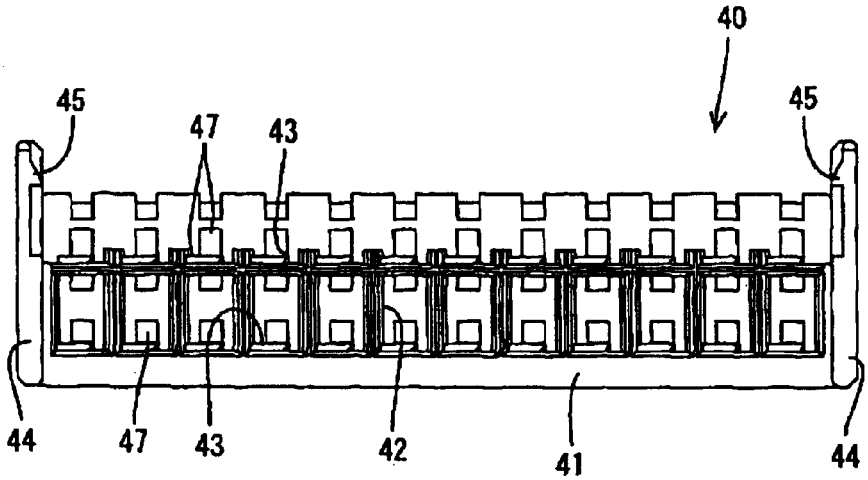
FIG. 11 is a rear view of the retainer.
Figure 12:
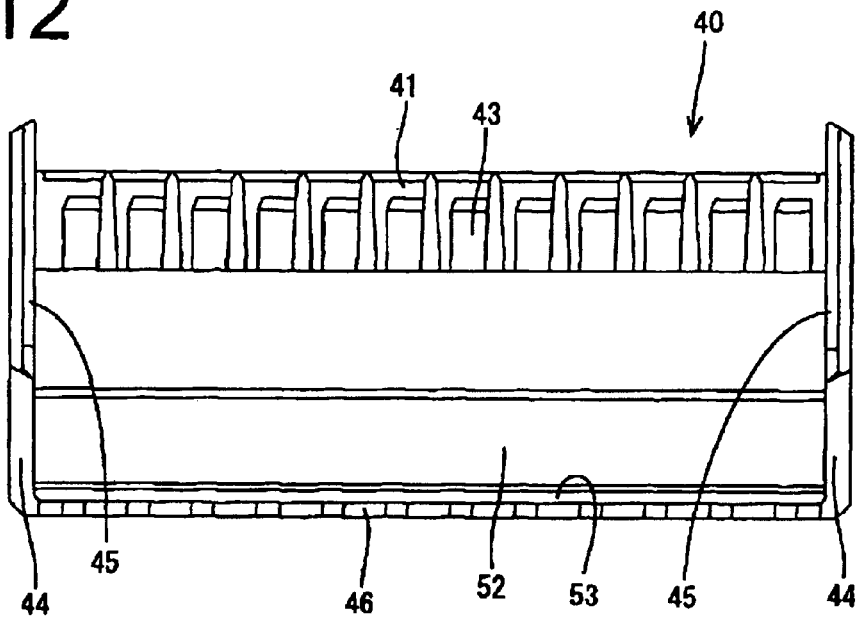
FIG. 12 is a plan view of the retainer.
Figure 13:
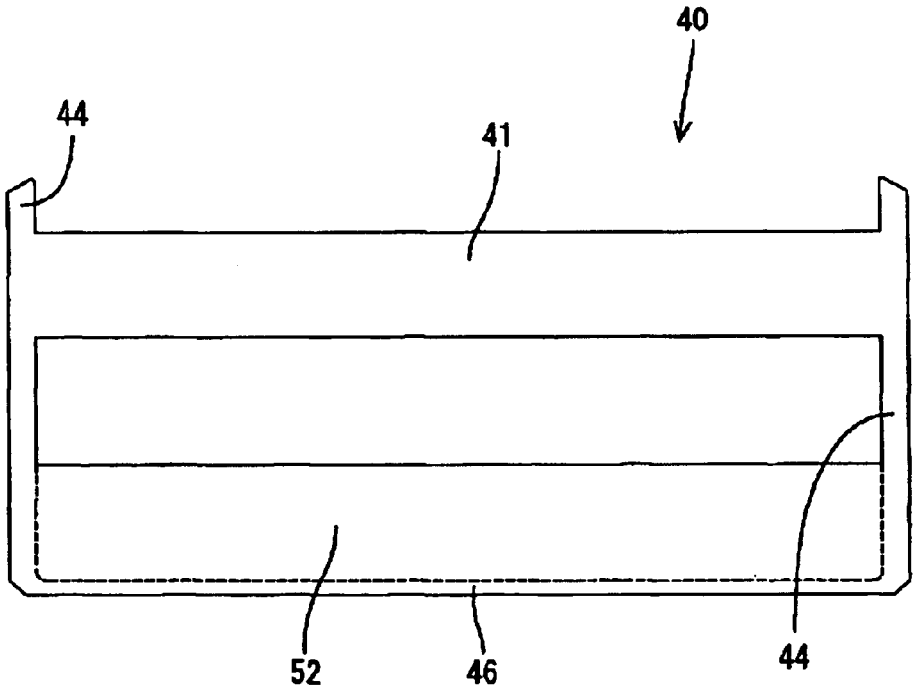
FIG. 13 is a section of the retainer.
Figure 14:
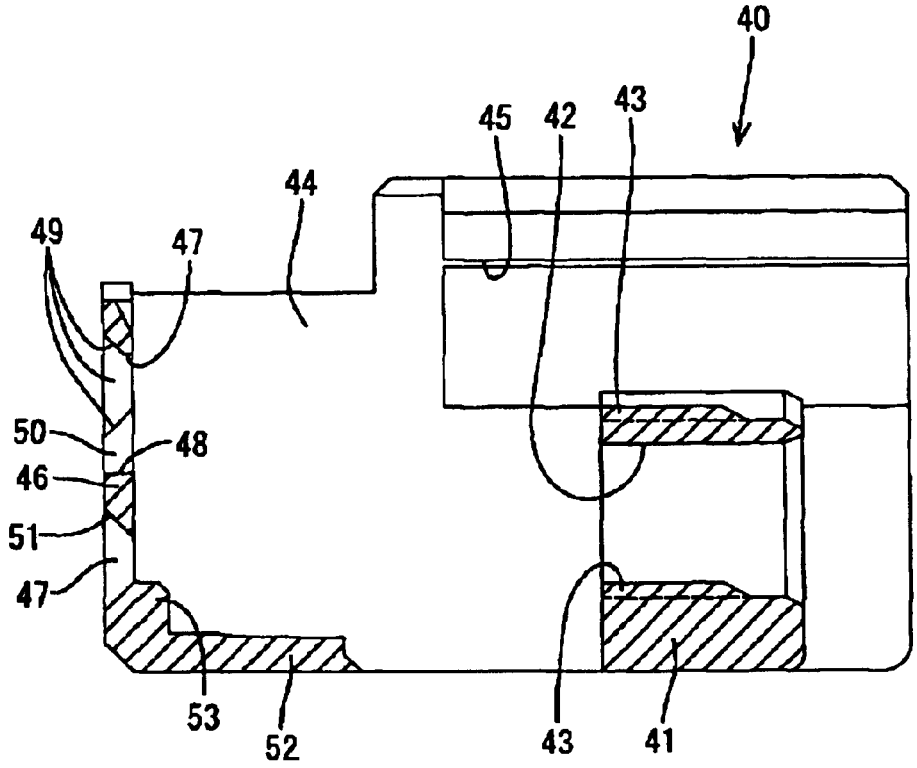
FIG. 14 is a bottom view of the retainer.

The connector is assembled by first mounting the retainer 40 at the partial locking position in the housing 10. The retainer 40 is brought closer to the housing 10 from below and in the mounting direction MD. The supports 44 fit into the mounting recesses 20; the retainer main body 41 fits into the mount space 22; and the front wall 46 slides into contact with the front surface of the housing 10. The upper end of the front wall 46 moves onto the housing-side guides 15 and undergoes a slight forward resilient deformation (see FIG. 7), to mount the retainer 40 at the partial locking position.

In this state, the respective insertion openings 14 of the housing 10 are closed at least partly by the front wall 46 of the retainer 40. The mold-removal spaces 13 at the upper stage are above the upper edges of the front wall 46 and are exposed to the outside. Additionally, the mold-removal spaces 13 at the lower stage are exposed to the outside via the jig insertion openings 48 that communicate with the through holes 47 at the upper stage. Further, the through holes 47 at the upper stage engage the housing-side guides 15.

The female terminal fittings 30 are inserted in the inserting direction ID into the respective cavities 11 along the forward and backward direction FBD while the retainer 40 is at the partial locking position. The inserted female terminal fittings 30 are locked by the engagement of the locks 12 with the first engaging portions 33.

The retainer 40 is moved in the mounting direction MD to the full locking position after of all of the female terminal fittings 30 have been inserted. Thus, the front wall 46 of the retainer slides along the front-end surface of the housing 10. At this time, the front wall 46 is guided by the sliding contact of the guiding surfaces 16 of the housing-side guides 15 and the guiding surfaces 50 of the jig insertion openings 48. The through holes 47 of the retainer 40 substantially align with the insertion openings 14 when the retainer 40 reaches the full locking position. Additionally, the mold-removal spaces 13 at the upper stage are substantially closed by the upper end of the front wall 46, and the mold-removal spaces 13 at the lower stage are substantially closed by portions of the front wall 46 between the jig insertion openings 48 and the through holes 47 at the lower stage.

The reinforcing wall 52 engages the cut-away portion 19 of the housing 10 to close the front ends of the lower stage cavities 11. Additionally, the front end surfaces of the female terminal fittings 30 in the cavities 11 at the lower stage are stopped by the bulge 53 in the accommodating portion 17 and are prevented from further forward movement. Further, the locking sections 43 of the retainer 40 engage the second engaging portions 34 of the female terminal fittings 30. In this way, the retainer 40 and the locks 12 lock the female terminal fittings 30 redundantly.

The retainer-side guides 49 are at the upper, left and right sides of the opening edges of the through holes 47 at the upper stage when the retainer 40 is at the full locking position and the housing-side guides 15 are at the bottom. Thus, tapered guides are formed around the periphery of the opening of each through hole 47 at the upper stage. Accordingly, a tab that is displaced up, down, left and/or right during insertion into the cavity 11, will be guided to the middle by sliding contact with the guides 15, 49. As a result, the displacement can be corrected and the tab can be guided to the through hole 47 and the insertion opening 14. It should be noted that the retainer-side guides 51 are formed over the entire periphery of each through hole 47 at the lower stage.

The female terminal fittings 30 can be withdrawn by first moving the retainer 40 to the partial locking position. As a result, the locks 43 disengage from the second engaging portions 34 of the female terminal fittings 30 to cancel the locking of the female terminal fittings 30 by the retainer 40. Movement of the retainer 40 also exposes the mold-removal spaces 13 forward via the jig insertion openings 48. Thus, a narrow jig (not shown) can be inserted into the jig insertion opening 48 to resiliently deform the lock 12 up and away from the terminal fitting 30, thereby canceling the locking of the terminal fitting 30 by the lock 12. The female terminal fitting 30 then may be pulled back in a withdrawing direction while maintaining the deformed state of the lock.

As described above, the through holes 47 face the insertion openings 14 at the upper stage when the retainer 40 is at the full locking position and the jig insertion openings 48 face the mold-removal spaces 13 at the lower stage when the retainer 40 is at the partial locking position. The retainer-side guides 49 and the housing-side guides 15 form the slanted guide surfaces around all opening edges of the through holes 47 at the upper stage. Thus, the tabs of the male terminal fittings can be guided securely to the insertion openings 14.

The guiding surfaces 16, 50 on the housing-side guides 15 and at the opening edges of the jig insertion openings 48 are substantially parallel with the sliding direction of the front wall 46 and to the mounting direction MD. Therefore the guiding surfaces 16, 50 slide in contact with each other as the retainer 40 is displaced. The front wall 46 can be moved along a specified path by the sliding contact of these guiding surfaces 16, 50.

The surfaces of the housing-side guides 15 substantially opposite from the insertion openings 14 at the upper stage define the slanted introducing surfaces 15B that face the opening edges of the jig insertion openings 48 for the adjacent cavities 11 at the lower stage. Thus, the jig can be securely inserted into the jig insertion opening 48.

As described above, the front wall 46 has the reinforcing wall 52 substantially normal to the wall surface of the front wall 46 and extending substantially in the transverse direction TD. Thus, the front wall 46 is prevented from curving along forward and backward directions FBD.

Opposite left and right edges of the reinforcing wall 52 are coupled to the supports 44. Therefore, displacements of the reinforcing wall 52 are restricted, and deformation of the front wall 46 is prevented more securely.

The reinforcing wall 52 is accommodated substantially completely in the cut-away portion 19 in the bottom wall 18 of the housing 10. Therefore, the reinforcing wall does not project out from the outer surface of the housing 10 when the retainer 40 is at the full locking position.

The locks 12 are at the side opposite the cut-away portion 19 in the cavities 11 at the lower stage. Thus, the reinforcing wall 52 engaged with the cut-away portion 19 does not interfere with the locks 12.

The bulge 53 partially increases the thicknesses of the front wall 46 and the reinforcing wall 52 at the corner portion where the front wall 46 and the reinforcing wall 52 join. Thus, the front wall 46 and the reinforcing wall 52 have a higher bending strength.

The bulge 53 for holding the female terminal fittings 30 at their front-limit positions in the cavities 11 at the lower stage and the locking sections 43 for locking the female terminal fittings 30 are maintained at a constant specified spacing along forward and backward directions FBD because both are formed in the retainer 40. Thus, even if the retainer 40 shakes along forward and backward directions FBD with respect to the housing 10 due to a dimensional tolerance or the like, the female terminal fittings 30 are held at their front-limit positions by the bulge 53 and do not shake forward and backward with respect to the retainer 40.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Both the housing-side guides and the opening edges of the jig insertion openings are formed with the guiding surfaces substantially parallel with the sliding direction of the front wall and/or the mounting direction MD as the guiding means in the foregoing embodiment. However, the guiding surfaces substantially parallel with the sliding direction of the front wall may be formed at either one of the housing-side guiding portions and the opening edges of the jig insertion openings according to the present invention.

The cavities are arrayed at the upper and lower stages in the foregoing embodiment. However, the invention is also applicable to connectors in which cavities are arrayed at one or at three or more stages.

What is claimed is:

1. A connector comprising:

a housing with opposite front and rear ends and at least one cavity extending between the ends, at least one insertion opening extending into the front end of the housing and into the cavity, at least one lock formed inside the housing substantially adjacent the cavity, and at least one mold-removal space extending into the front end of the housing and communicating with the lock;

a terminal fitting inserted in the cavity along an inserting direction and locked by the lock, the terminal fitting being withdrawable from the cavity by disengaging the lock from the terminal fitting with a jig insertable into the mold-removal space;

a retainer displaceable in a direction intersecting the inserting direction of the terminal fitting between a first position where insertion and withdrawal of the terminal fitting is permitted and a second position where the retainer engages and locks the terminal fitting in the housing, the retainer having a front wall slidable along the front end of the housing, the front wall having at least one through hole substantially facing the insertion opening when the retainer is at the second position and at least one jig insertion opening substantially facing the mold-removal space when the retainer is at the first position, wherein:

a tapered retainer-side guide is formed in an area of an opening edge of each through hole, and the front end of the housing has at least one tapered housing-side guide.

2. The connector of claim 1, wherein guiding means is provided at the housing-side guide and the opening edge of the jig insertion opening for sliding contact with each other as the retainer is displaced, the guiding means being substantially parallel with a sliding direction of the front wall.

3. The connector of claim 1, wherein a surface of the housing-side guide substantially opposite the corresponding insertion opening defines a slanted introducing surface substantially facing the opening edge of the jig insertion opening for an adjacent cavity.

4. The connector of claim 1, wherein the front wall has at least one reinforcing portion projecting at an angle to a wall surface of the front wall and extending substantially in a transverse direction.

5. The connector of claim 1, wherein the through hole and jig insertion opening communicate with each other.

6. The connector of claim 5, wherein tapered retainer-side guide is formed in an area of the opening edge of the through hole excluding a communicating area with the jig insertion opening.

7. The connector of claim 6, wherein the tapered housing-side guide is at the communicating area of the opening edge of the through hole with the jig insertion opening when the retainer is at the second position.

8. A connector comprising:

a housing with front and rear ends, first and second cavities spaced apart along a moving direction, first and second insertion openings extending into the front end and communicating with the respective first and second cavities, locks in the housing adjacent the respective cavities, first and second mold-removal spaces extending into the front end and aligned respectively with the locks of the first and second cavities, a housing-side guide projecting at the front end between the first insertion opening and the second mold-removal space, each said housing-side guide having a tapered guide surface aligned for guiding a mating terminal fitting into the first insertion opening; and a retainer displaceable in the moving direction between first and second positions, the retainer having a front wall slidable along the front end of the housing, a communication opening in the front wall and slidably engaged with the housing-side guide, a through hole and a jig insertion opening adjacent the communication opening, the jig insertion opening being aligned with the second mold-removal spacer when the retainer is at the first position and the through hole being aligned with the first insertion opening when the retainer is at the second position, and tapered retainer-side guides adjacent said through hole aligned for guiding the mating terminal fitting into the cavity when the retainer is at the second position.

9. The connector of claim 8, wherein the housing-side guide and the communication opening have interengaged guiding surfaces aligned substantially parallel with the moving direction.

10. The connector of claim 8, wherein the housing-side guide has a slanted introducing surface substantially facing an opening edge of the second jig insertion opening.

11. The connector of claim 8, wherein the through hole and the jig insertion opening both open into communication with the communication opening.

12. The connector of claim 8, wherein the through hole is a first through hole, the front wall of the retainer further having a second through hole spaced from the first through hole and spaced from the communication opening and the jig insertion opening, the second through hole being aligned with the second insertion opening when the retainer is at the second position.

13. The connector of claim 12, wherein the first through hole, the communication opening, the jig insertion opening and the second through hole all are substantially aligned along the moving direction.

14. A connector comprising:

a housing with front and rear ends, first and second stages of cavities arranged so that each said cavity of the first stage is aligned with one said cavity of the second stage along a moving direction, insertion openings extending into the front end and communicating with the respective cavities, locks formed in the housing adjacent the cavities, mold removal spaces extending into the front end and aligned respectively with the locks, housing-side guides projecting from the front end between the first and second stages of cavities, each said housing-side guide having a tapered guide surface aligned for guiding a mating terminal fitting into one of the insertion openings of the first stage of cavities; and a retainer displaceable in the moving direction between a first position and a second position, the retainer having a front wall slidable along the front end of the housing, communication openings formed through the front wall and slidably engaged respectively with the housing-side guides, through holes and jig insertion openings adjacent the communication openings, the jig insertion openings being aligned respectively with the mold removal spaces for the second stage of cavities when the retainer is at the first position, the through holes being aligned with the insertion openings for the first stage of cavities when the retainer is at the second position, each said through hole having tapered retainer-side guides aligned for guiding the mating terminal fitting into the corresponding cavity of the first stage when the retainer is at the second position.

15. The connector of claim 14, wherein the housing-side guide and the communication openings have interengaged guiding surfaces aligned substantially parallel with the moving direction.

16. The connector of claim 14, wherein the each of the housing-side guides has a slanted introducing surface substantially facing an opening edge of the second jig insertion opening.

* * * * *